US011033132B2

(12) United States Patent
Morewitz et al.

(10) Patent No.: US 11,033,132 B2
(45) Date of Patent: Jun. 15, 2021

(54) CUP WITH LID-ENGAGING SPILL-PROOF SEAL

(71) Applicants: Cory L Morewitz, Newport News, VA (US); Herbert Morewitz, II, Newport News, VA (US)

(72) Inventors: Cory L Morewitz, Newport News, VA (US); Herbert Morewitz, II, Newport News, VA (US)

( * ) Notice: Subject to any disclaimer, the term of this patent is extended or adjusted under 35 U.S.C. 154(b) by 0 days.

(21) Appl. No.: 15/165,345

(22) Filed: May 26, 2016

(65) Prior Publication Data

US 2016/0347519 A1 Dec. 1, 2016

Related U.S. Application Data

(60) Provisional application No. 62/166,828, filed on May 27, 2015.

(51) Int. Cl.
*A47G 19/22* (2006.01)

(52) U.S. Cl.
CPC ..... *A47G 19/2272* (2013.01); *A47G 19/2288* (2013.01)

(58) Field of Classification Search
CPC ..... A47G 19/2266; A47G 19/2205; A47G 19/20; A47G 19/22; A47G 19/2272; A47G 19/2288; A47G 2023/0291; A47G 2023/0275; A47G 23/0208–0266; B65D 81/3876
USPC .. 220/592.16, 592.17, 592.2, 737, 738, 739, 220/740, 741, 742, 614, 681; 215/387, 215/390, 45
See application file for complete search history.

(56) References Cited

U.S. PATENT DOCUMENTS 3,705,661 A * 12/1972 Davis ..... A47J 41/02 215/12.1
9,669,987 B2 * 6/2017 Stahlecker ..... B65D 81/3874
2008/0006643 A1 * 1/2008 Ma ..... A47J 41/0011 220/592.16
2013/0233871 A1 * 9/2013 Gluck ..... B65D 25/34 220/737
2013/0233872 A1 * 9/2013 Tessier ..... B65D 25/34 220/737
2015/0108146 A1 * 4/2015 Jameson ..... B65D 81/3869 220/592.16

* cited by examiner

*Primary Examiner* — Kareen K Thomas
(74) *Attorney, Agent, or Firm* — Peter J. Van Bergen

(57) ABSTRACT

A cup includes a liquid-holding container having an open top. A sleeve is disposed about an exterior surface of the container for movement relative to the container. A sealing element is disposed adjacent to the container's open top for movement relative to the container. A link assembly is coupled to the sleeve and to the sealing element for causing movement of the sleeve and movement of the sealing element to be in opposing directions.

14 Claims, 4 Drawing Sheets

CUP WITH LID-ENGAGING SPILL-PROOF SEAL

Pursuant to 35 U.S.C. § 119, the benefit of priority from provisional application 62/166,828, with a filing date of May 27, 2015, is claimed for this non-provisional application.

FIELD OF THE INVENTION

The invention relates generally to travel cups and mugs, and more particularly to a cup having a lid-engaging sealing element that provides a spill-proof seal.

BACKGROUND OF THE INVENTION

Travel cups or mugs filled with hot or cold liquids go from home to car, and then on to the office, gym, etc., and vice versa, every day. Regardless of their design, the lid of a travel mug has an opening through which a user drinks. When not being held, these mugs are set down on counters, dashboards, consoles, desks, etc. In general, the surfaces on which a travel cup/mug sits are areas of high activity and/or can be sloped or uneven. As a result, travel cups/mugs are often knocked over. When this occurs, liquid in the cup/mug flows through the lid's drink opening to create a spill.

SUMMARY OF THE INVENTION

Accordingly, it is an object of the present invention to provide a cup/mug that will not spill its contents through a lid's drink hole when the cup/mug is knocked over.

Another object of the present invention is to provide a cup/mug that can seal a lid's drink hole when the cup/mug is upright and when it is knocked over, but is unsealed from the lid's drink hole automatically when one tips the cup/mug to drink therefrom.

Other objects and advantages of the present invention will become more obvious hereinafter in the specification and drawings.

In accordance with the present invention, a cup includes a liquid-holding container having an open top. A sleeve is disposed about an exterior surface of the container for movement relative to the container. A sealing element is disposed adjacent to the container's open top for movement relative to the container. A link assembly is coupled to the sleeve and to the sealing element for causing the movement of the sleeve and the movement of the sealing element to be in opposing directions.

BRIEF DESCRIPTION OF THE DRAWINGS

Other objects, features and advantages of the present invention will become apparent upon reference to the following description of the preferred embodiments and to the drawings, wherein corresponding reference characters indicate corresponding parts throughout the several views of the drawings and wherein.

DETAILED DESCRIPTION OF THE INVENTION

Figure 1:
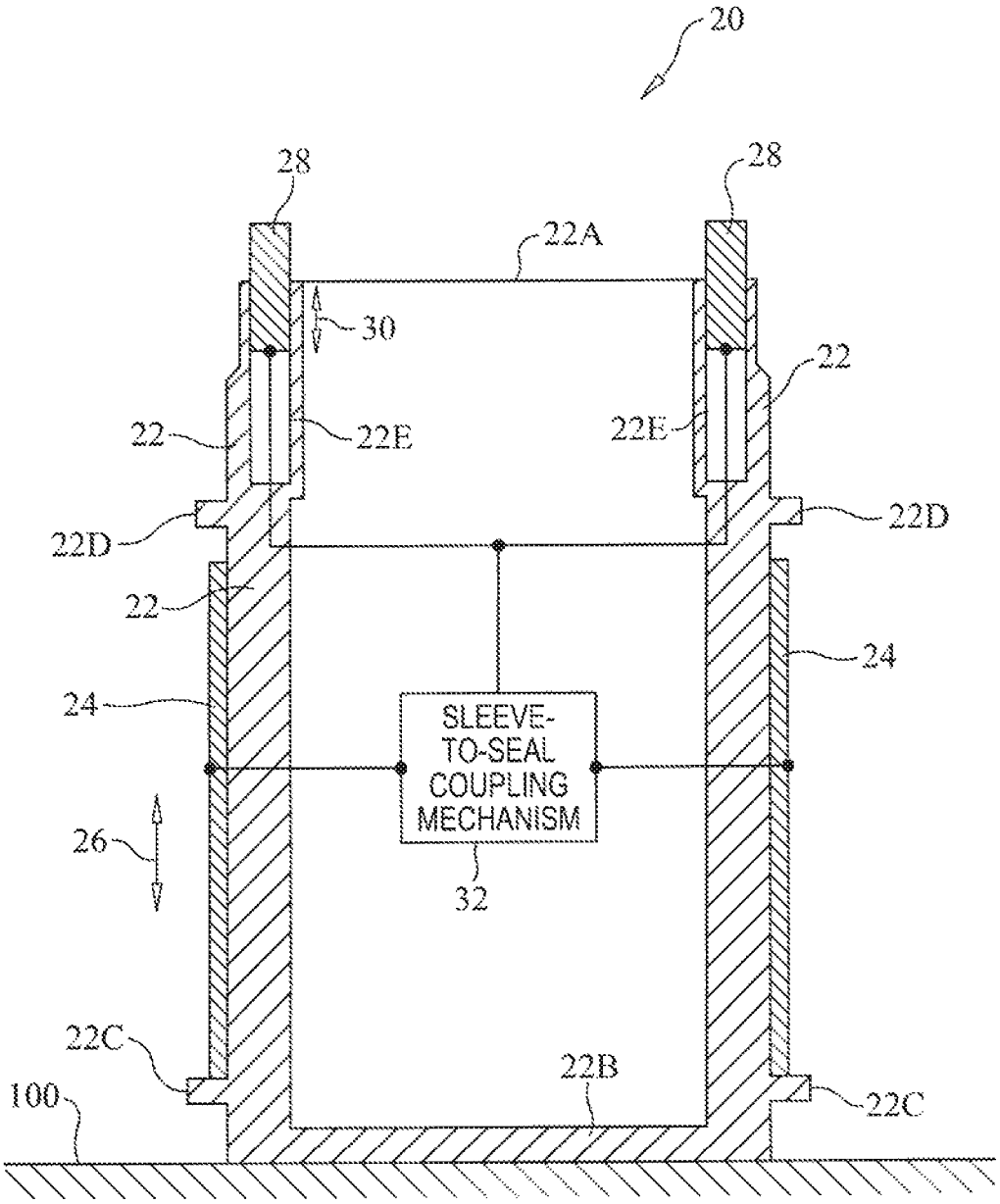
FIG. 1 is an exploded cross-sectional view of cup having a lid-engaging spill-proof seal system in accordance with an embodiment of the present invention.

Referring now to the drawings and more particularly to FIG. 1, a cup having a lid-engaging spill-proof seal system in accordance with an embodiment of the present invention is shown and is referenced generally by numeral 20. In FIG. 1, cup 20 is shown with its sealing and spill-proof features positioned for engagement with the drink hole of a lid (not shown). These features will be shown cooperating with a lid's drink hole later below.

Cup 20 includes a liquid container 22 that can be made from a variety of materials without departing from the scope of the present invention. For example, container 22 can be fabricated using materials that provide thermal insulation for the liquid placed therein. Container 22 can also be a variety of shapes and sizes. Container 22 has an open top 22A and a closed bottom 22B. Disposed about a portion of the exterior surface of container 22 is an annular sleeve 24 that is also coupled to container 22 in a way that allows a fixed amount of axial travel of sleeve 24 axially along container 22 as indicated by two-headed arrow 26. End points of axial travel 26 can be defined by, for example, a lower stop 22C and an upper stop 22D provided on (or integral with) the exterior surface of container 22. In addition or alternatively, a portion of the inside surface of sleeve 24 could be configured for an indexed relationship with a portion of the outside surface of container 22 (e.g., using tongue-and-groove principles). In terms of a tongue-and-groove indexing scheme, the axial or longitudinal ends of the groove (either in container 22 or sleeve 24) define the stops for axial travel 26 of sleeve 24 that will engage a tongue (that is formed on either container 22 or sleeve 24).

In general, sleeve 24 covers a portion of container 22 that is typically gripped by a user when picking up container 22. When cup 20 rests on a surface 100 as shown, sleeve 24 is only acted upon by the force of gravity such that sleeve 24 is at its point of axial travel that is closest to container bottom 22B. When a user grips sleeve 24 and lifts upward, sleeve 24 travels axially up along container 22 against the force of gravity until sleeve 24 reaches its upward end point of axial travel (e.g., at stop 22D) that is closest to container top 22A at which point cup 20 is raised off surface 100 by the user's continuing lift motion.

Mounted on or in container 22 near container top 22A are one or more sealing element(s) 28, e.g., within a sleeve(s) 22E defined in the walls of container 22 as shown. For example, sealing element 28 can be a single annular sealing ring or tube slidingly fitted in sleeve 22E near container top 22A. Sealing element 28 can be made from a flexible sealing material such as silicone. In general, sleeve 22E in container 22 supports sealing element 28 in a way that provides for a fixed amount of axial travel thereof along container 22 as indicated by two-headed arrow 30. Axial travel of sealing element 28 is controlled by the axial travel of sleeve 24. In general, axial travel 26 of sleeve 24 towards container top 22A causes axial travel 30 of sealing element 28 towards container bottom 22B. Conversely, axial travel 26 of sleeve 24 towards container bottom 22B causes axial travel 30 of sealing element 28 towards container top 22A. Further, when cup 20 is resting on surface 100, sleeve 24 is acted on by the force of gravity such that sleeve 24 is at its closest point relative to container bottom 22B to cause a portion of sealing element 28 to extend from sleeve 22E and be above container top 22A as illustrated in FIG. 1.

A sleeve-to-seal coupling mechanism 32 is provided within the side walls of container 22 for the purpose of coupling sleeve 24 to sealing element 28. Coupling mechanism 32 converts the direction of the sleeve's axial travel 26 into an opposing direction of the sealing element's axial travel 30. In this way, when sleeve 24 moves towards container top 22A, sealing element 28 moves away from container top 22A and fully into sleeve 22E. Conversely, when sleeve 24 moves down towards container bottom 22A, sealing element 28 moves towards container top 22A and ultimately extends partially from sleeve 22E when sleeve 24 is at its lowest point of axial travel 26.

Figure 2A:
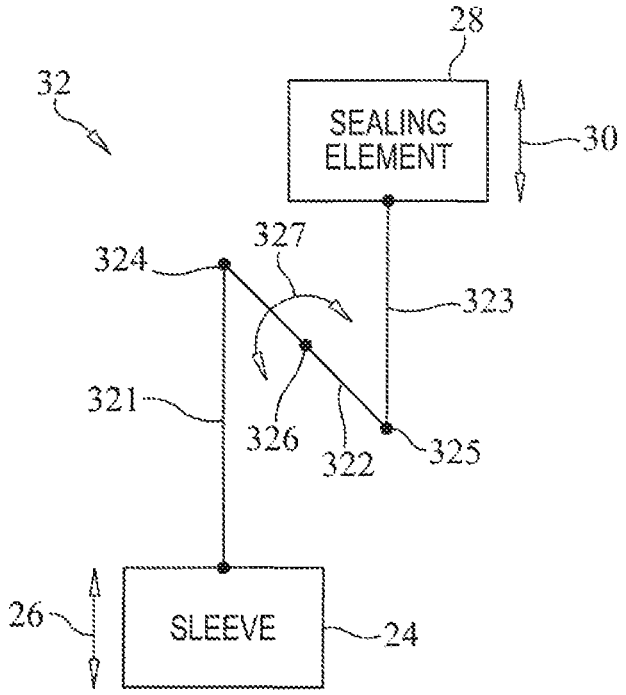
FIG. 2A is an isolated schematic view of a sleeve-to-seal coupling mechanism in accordance with an embodiment of the present invention.

A variety of constructions for coupling mechanism 32 could be used without departing from the scope of the present invention. By way of example, three mechanical coupling mechanisms that support the above-described opposing directions of axial travel 26 and axial travel 30 are illustrated schematically in FIGS. 2A-2C. In FIG. 2A, coupling mechanism 32 includes three rods 321, 322 and 323 that are linked together via pivot joints or hinges 324 and 325. More specifically, rod 321 is coupled to sleeve 24 and hingedly coupled to rod 322 at hinge 324; rod 323 is coupled to sealing element 28 and hingedly coupled to rod 322 at hinge 325; and rod 322 is supported via a pivot mount 326 that supports pivot movement as indicated by two-headed arrow 327.

Figure 2B:
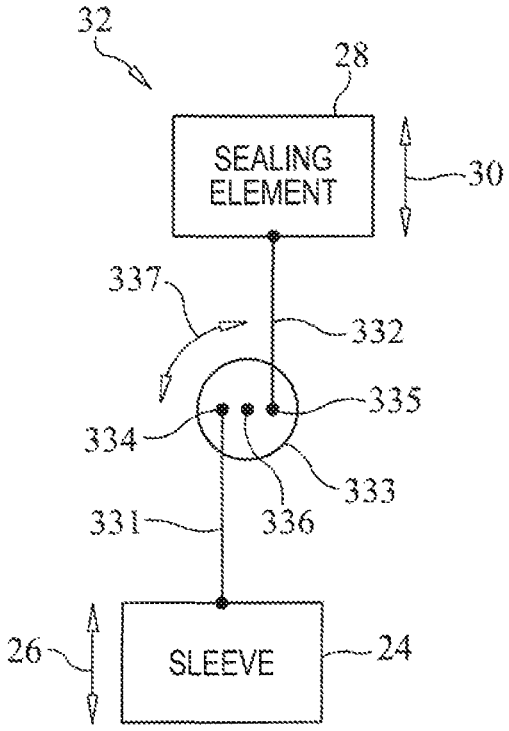
FIG. 2B is an isolated schematic view of a sleeve-to-seal coupling mechanism in accordance with another embodiment of the present invention.

In FIG. 2B, coupling mechanism 32 includes two rods 331 and 332, and a rotatable joint 333. More specifically, rod 331 is coupled to sleeve 24 and pivotally coupled to joint 333 at a pivot 334; rod 332 is coupled to sealing element 28 and pivotally coupled to joint 333 at a pivot 335; and rotatable joint 333 is supported via a pivot mount 336 that supports pivot movement as indicated by two-headed arrow 337.

Figure 2C:
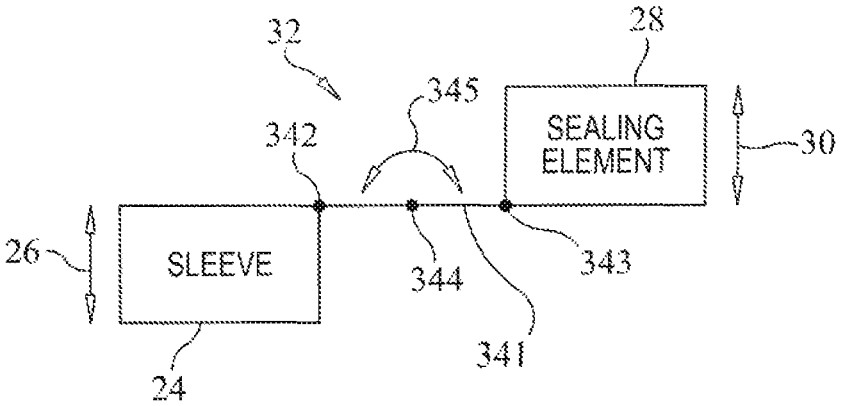
FIG. 2C is an isolated schematic view of a sleeve-to-seal coupling mechanism in accordance with still another embodiment of the present invention.

In FIG. 2C, coupling mechanism 32 includes a single rod 341 that is pivotally coupled on one end thereof to sleeve 24 at a joint/pivot 342, and pivotally coupled on the other end thereof to sealing element 28 at a joint/pivot 343. Rod 341 is supported via a pivot mount 344 that supports pivot movement as indicated by two-headed arrow 345.

Figure 3:
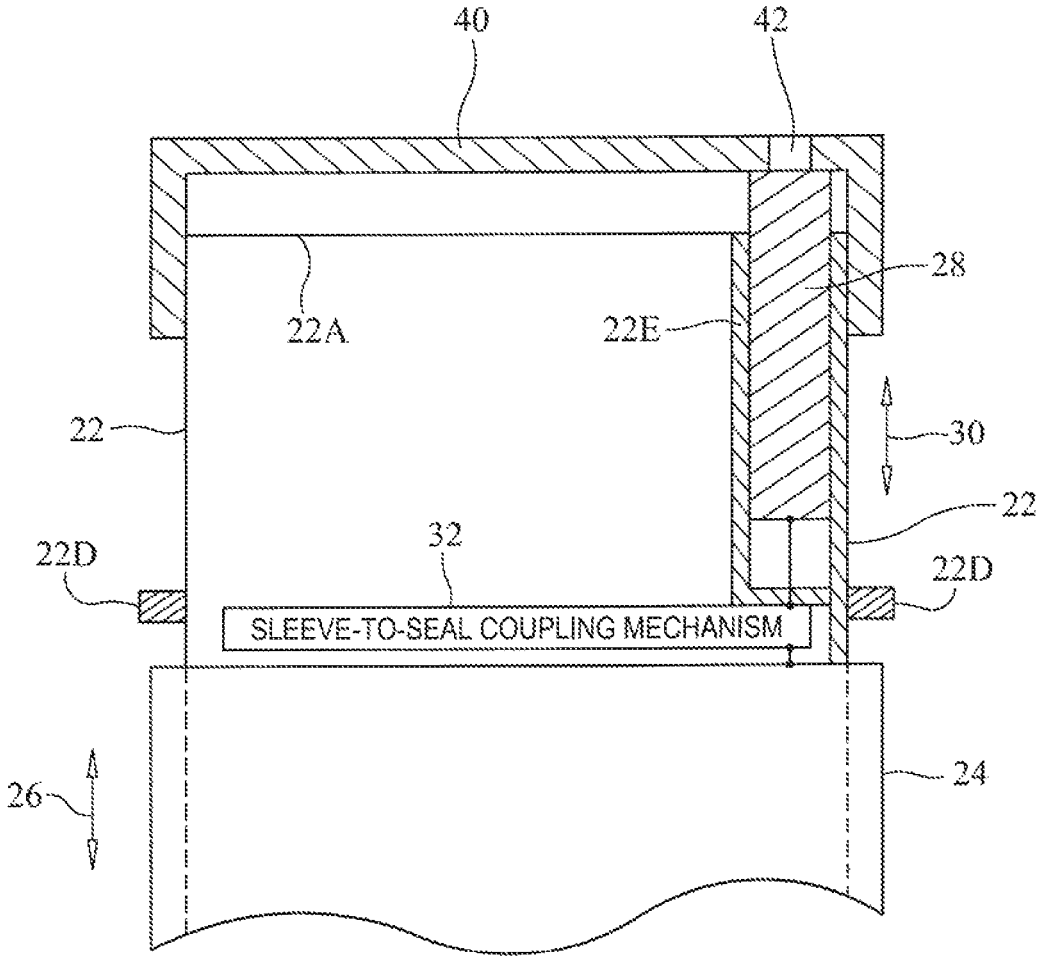
FIG. 3 is a part schematic and part cross-sectional view of a portion of a cup and a conventional lid illustrating the cup's sealing element held in a sealing relationship with the lid's drink hole in accordance with an embodiment of the present invention.
Figure 4:
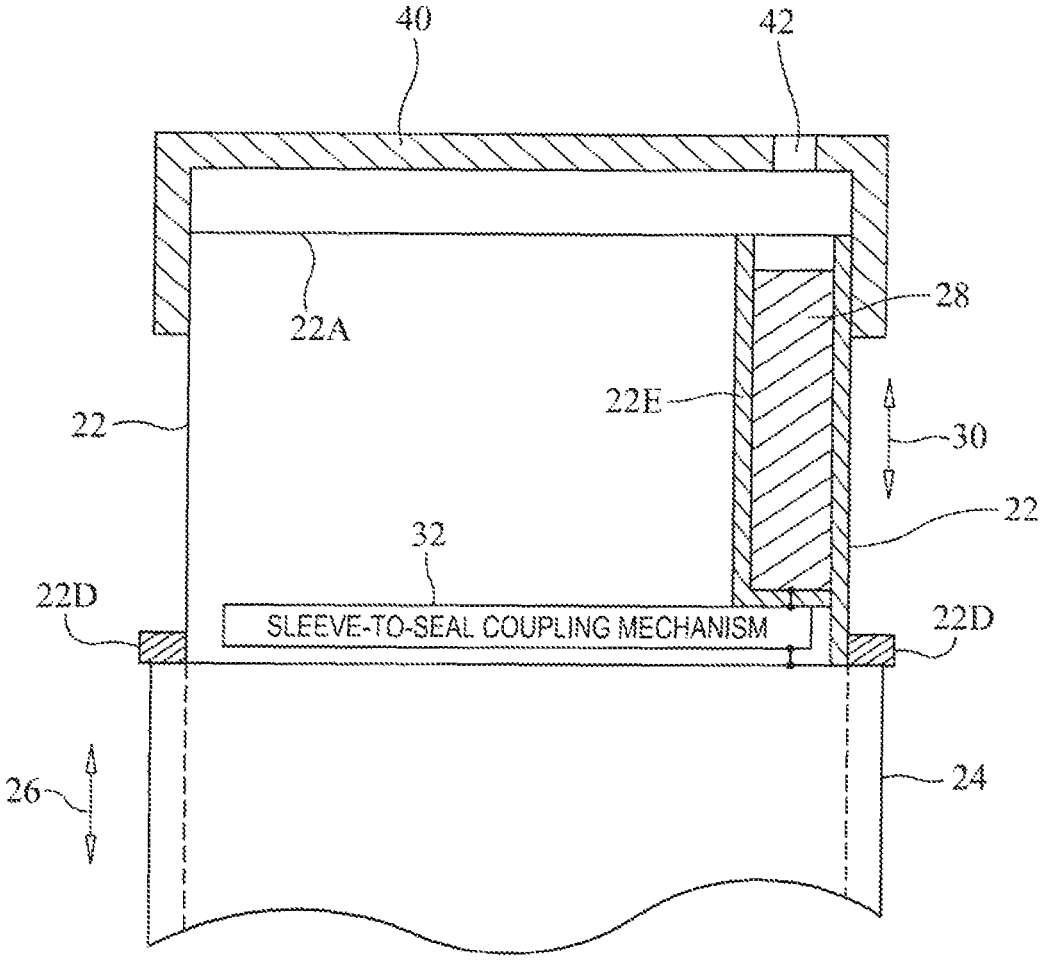
FIG. 4 is a part schematic and part cross-sectional view of a portion of a cup and a conventional lid illustrating the cup's sealing element when it has been moved to a position that permits drinking through the lid's drink hole.

The sealing and spill-proof features of the present invention provided by cup 20 are illustrated in FIG. 3, whereas the retraction of the sealing and spill-proof features is illustrated in FIG. 4. A conventional lid 40 having a drink hole 42 is coupled to container top 22A. As is the case with most such lids, drink hole 42 is located near the periphery of lid 40. For clarity of illustration, only the portion of sleeve 22E and sealing element 28 aligned with drink hole 42 is shown.

In FIG. 3, it is assumed that sleeve 24 is not being gripped/lifted by a user such that sleeve 24 is being acted on only by the force of gravity. As a result, sleeve 24 abuts lower stop 22C (FIG. 1) and is at its lowest point of axial travel 26 causing sealing element 28 to be at its highest point of axial travel 30 where a portion of sealing element 28 is pushed up to engage the underside of lid 40 to seal against drink hole 42. In this position, sealing element 28 effectively seals drink hole 42 when cup 20 is upright (as shown). In addition, if cup 20 is knocked over, sleeve 24 will not move axially by an appreciable amount towards container top 22A so that sealing element 28 will still operate to seal drink hole 42.

Referring now to FIG. 4, sleeve 24 is assumed to have been gripped by a user and lifted up to overcome the force of gravity such that sleeve 24 moves up to its highest point of axial travel 26 adjacent to stop 22D. As a result, sealing element 28 is moved to its lowest point of axial travel 30 such that sealing element 28 retracts into sleeve 22C. When this occurs, drink hole 42 is unsealed allowing a user to drink therefrom while holding cup 20 via sleeve 24.

The advantages of the present invention are numerous. A drinking hole in a cup's lid is only exposed when a user purposefully lifts the cup and tips same to take a drink. At all other times to include when it is knocked over, the lid's drink hole is sealed by the cup's sealing element.

Although the invention has been described relative to a specific embodiment thereof, there are numerous variations and modifications that will be readily apparent to those skilled in the art in light of the above teachings. It is therefore to be understood that, within the scope of the appended claims, the invention may be practiced other than as specifically described.

What is claimed as new and desired to be secured by Letters Patent of the United States is:

1. A cup comprising:

a liquid-holding container having an open top;

a sleeve disposed about an exterior surface of said container for movement relative to said container;

a sealing element disposed adjacent to said open top of said container for movement relative to said container; and a coupling mechanism coupled to said sleeve and to said sealing element for causing said movement of said sleeve and said movement of said sealing element to be in opposing directions, wherein said coupling mechanism comprises at least one rod and at least one movable joint coupled to said at least one rod.

2. A cup as in claim 1, wherein said container comprises a thermally insulating container.

3. A cup as in claim 1, wherein said sealing element comprises a ring-shaped element.

4. A cup as in claim 1, further comprising stops coupled to said container and positioned to define a fixed amount of said movement of said sleeve.

5. A cup as in claim 1, wherein said sealing element is disposed within a wall of said container.

6. A cup comprising:

a liquid-holding container having an open top;

a sleeve disposed about an exterior surface of said container for axial movement relative to said container;

a sealing element disposed adjacent to said open top of said container for axial movement relative to said container; and a coupling mechanism coupled to said sleeve and to said sealing element for causing said axial movement of said sleeve and said axial movement of said sealing element to be in opposing directions, wherein said axial movement of said sealing element is towards said open top when said axial movement of said sleeve opposes a force of gravity, and wherein said coupling mechanism comprises at least one rod and at least one movable joint coupled to said at least one rod.

7. A cup as in claim 6, wherein said container comprises a thermally insulating container.

8. A cup as in claim 6, wherein said sealing element comprises a ring-shaped element.

9. A cup as in claim 6, further comprising stops coupled to said container and positioned to define a fixed amount of said axial movement of said sleeve.

10. A cup as in claim 6, wherein said sealing element is disposed within a wall of said container.

11. A cup comprising:

a liquid-holding container having an open top;

a sleeve disposed about an exterior surface of said container for movement relative to said container;

a sealing element disposed within a wall of said container and adjacent to said open top of said container for movement relative to said container;

a coupling mechanism coupled to said sleeve and to said sealing element for causing said movement of said sleeve and said movement of said sealing element to be in opposing directions, wherein said sealing element remains within said wall of said container when said sleeve is only subject to a force of gravity, wherein said sealing element extends from said wall when said movement of said sleeve opposes the force of gravity, and wherein said coupling mechanism comprises at least one rod and at least one movable joint coupled to said at least one rod.

12. A cup as in claim 11, wherein said container comprises a thermally insulating container.

13. A cup as in claim 11, wherein said sealing element comprises a ring-shaped element.

14. A cup as in claim 11, further comprising stops coupled to said container and positioned to define a fixed amount of said movement of said sleeve.

* * * * *